US006418860B1

(12) United States Patent
Hinderhofer

(10) Patent No.: US 6,418,860 B1
(45) Date of Patent: Jul. 16, 2002

(54) ADJUSTABLE TABLE FOR EDP SYSTEM

(76) Inventor: Jürgen Hinderhofer, Engelgasse 6, D-88400 Biberach (DE)

( * ) Notice: Subject to any disclaimer, the term of this patent is extended or adjusted under 35 U.S.C. 154(b) by 0 days.

(21) Appl. No.: 09/674,143

(22) PCT Filed: Mar. 31, 1999

(86) PCT No.: PCT/DE99/00980

§ 371 (c)(1),
(2), (4) Date: Nov. 13, 2000

(87) PCT Pub. No.: WO99/56439

PCT Pub. Date: Nov. 4, 1999

(30) Foreign Application Priority Data

Apr. 24, 1998 (DE) ..... 198 18 457

(51) Int. Cl.[7] ..... A47B 37/00
(52) U.S. Cl. ..... 108/50.01; 108/10
(58) Field of Search ..... 108/10, 9, 50.01, 108/50.02; 248/125.8, 133, 149, 371, 398, 161, 157

(56) References Cited

U.S. PATENT DOCUMENTS 520,630 A * 5/1894 Bramwell
2,005,481 A * 6/1935 Skoogh
2,041,772 A * 5/1936 Lundwuist
4,058,066 A * 11/1977 Altman ..... 108/9
4,714,244 A * 12/1987 Calmes ..... 108/10 X
5,357,873 A * 10/1994 Hilton ..... 108/50.01
5,671,091 A * 9/1997 Monroe et al. ..... 108/9 X
5,704,299 A * 1/1998 Corpuz, Jr. et al. ..... 108/50.01
5,845,586 A * 12/1998 Moore ..... 108/50.01
5,868,079 A * 2/1999 Charny ..... 108/50.01 X
6,158,357 A * 12/2000 Shih ..... 108/50.01
6,196,140 B1 * 3/2001 Newhouse et al. ..... 108/50.01
6,298,794 B1 * 10/2001 Brown et al. ..... 108/50.01

* cited by examiner

*Primary Examiner*—Jose V. Chen
(74) *Attorney, Agent, or Firm*—Herbert Dubno

(57) ABSTRACT

The invention relates to an adjustable table for an EDP system having a monitor (17) and a keyboard (18), the table having a telescoping column (14, 15) with at least one fixed part (14) and one movable part, a table top (11) on which a subpanel (12) is pivotal about an axis (22) parallel to a front edge of the table top, characterized in that the subpanel (12) is connected via a strut (13) with the fixed part (14) of the telescoping column (14, 15).

17 Claims, 6 Drawing Sheets

Fig.1
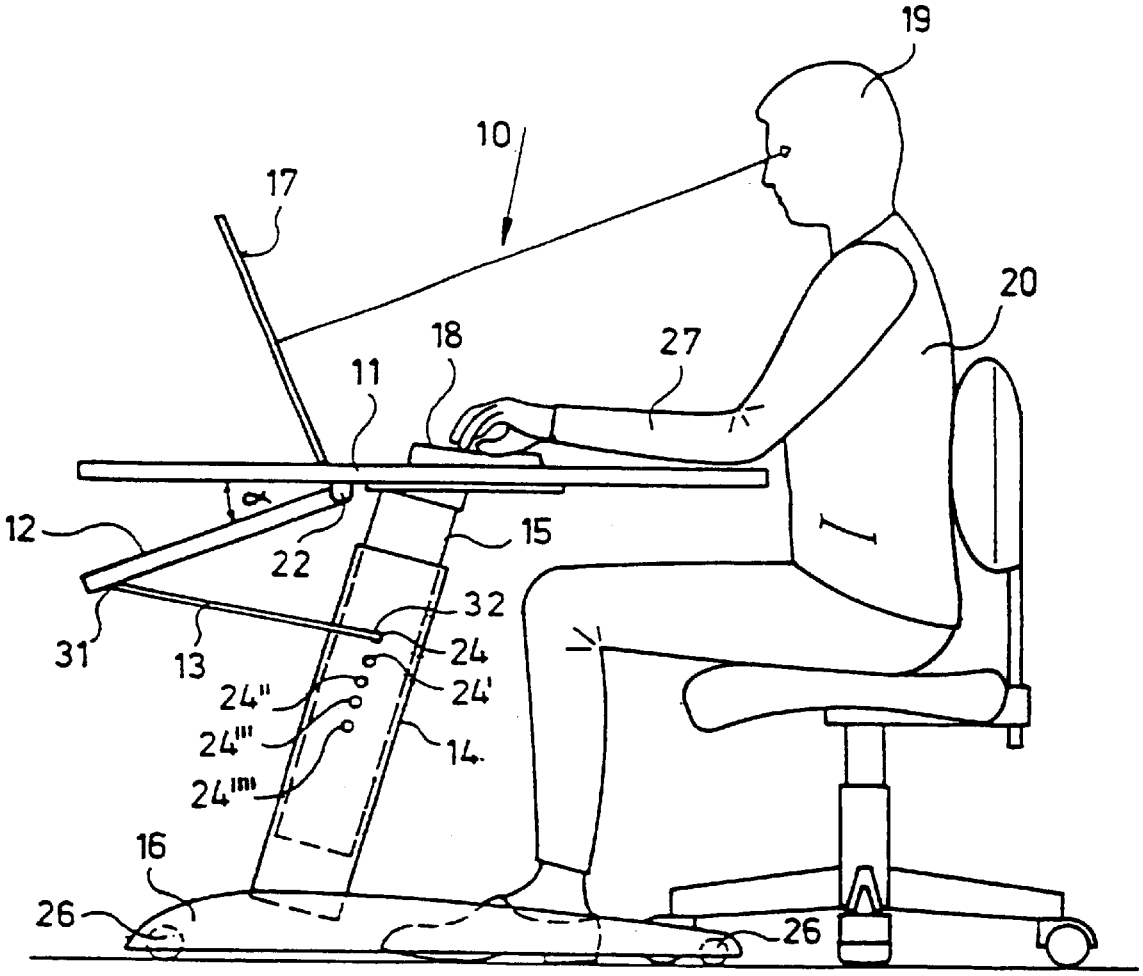
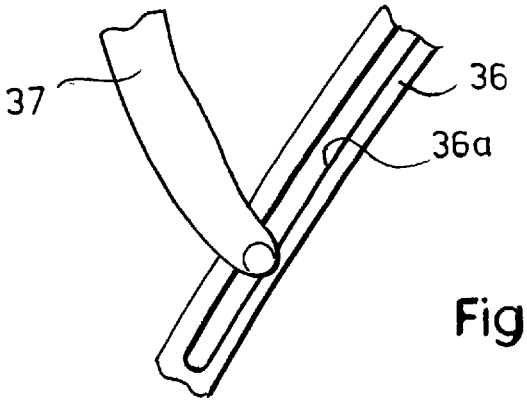
Fig. 5A

ADJUSTABLE TABLE FOR EDP SYSTEM

CROSS REFERENCE TO RELATED APPLICATIONS

This application is the US national phase of PCT application PCT/DE99/00980 filed Mar. 31, 1999 with claim to the priority of German patent application 19818457.3 itself filed Apr. 24, 1998.

FIELD OF THE INVENTION

The invention relates to an adjustable table for a monitor and a keyboard of an EDP system, the table having at least one telescoping column with a fixed part and a movable part and a table top on which a subpanel is pivotal about an axis parallel to a front edge of the table top.

BACKGROUND OF THE INVENTION

Tables for EDP systems are used in many applications as work spaces for persons of different sizes. Although the tables are normally adjustable with respect to height and even usually tippable about a longitudinal axis, they typically have the disadvantage that the distance from the head of the user to the monitor and the angle of inclination of the head of the user change when the table is used by people of different size.

OBJECT OF THE INVENTION

It is an object of the invention to provide a table where a predetermined angle of inclination of the head of a user directed at the monitor of an EDP system mounted on the table can be adjusted independently of the size of the user in a simple manner.

SUMMARY OF THE INVENTION

This object is attained for a table of the above-described type in that the subpanel is connected via a strut with the fixed part of the telescoping column.

Thus an adjustable table for an EDP system can have a monitor and a keyboard, the table having a telescoping column with at least one fixed part and one movable part and a table top on which a subpanel is pivotal about an axis parallel to a front edge of the table top. The subpanel is connected via a strut with the fixed part of the telescoping column.

With the table according to the invention the arrangement of the monitor of the EDP system on the table-top subpanel which is pivotal about an axis that extends parallel to the front edge of the table top, with the table top supported by at least one strut, ensures that when the movable part of the telescoping column is moved relative to the fixed part of the telescoping column, i.e. the table-top height is adjusted, the angle of the table-top subpanel on which the monitor of the EDP system is mounted is automatically changed such that the user of the EDP system looks at the same angle at the monitor of the EDP system. This positioning is achieved with the table according to the invention by the strut connected to the telescoping column in a remarkable manner without the help of additional adjustment motors and solely through the relative movement of the movable part of the telescoping column relative to the fixed part thereof. The length of the strut is set such that for example in the seated position of a user it produces a predetermined ergonomically comfortable angle of inclination of the head of the user while looking at the monitor of the EDP system. As a result of the interaction of the various parts of the table according to the invention only under these circumstances is the inclination angle even maintained when the movable part of the telescoping column moves upward out of the fixed part in a raised position of the table in which the EDP-system user is standing.

According to a preferred embodiment the strut is connected to a floor plate that carries the telescoping column.

According to a preferred embodiment of the table according to the invention a pivot axis of the subpanel is set 2 cm to 5 cm below an upper surface of the table top. In this manner on the one hand there is an ergonomically very comfortable angle of the head of the user looking at the monitor and on the other hand the monitor lies somewhat below the overall table-top upper surface so that the user can easily see over the monitor out into the surrounding space so as to more easily make contact with other people and to be able to communicate from the work space unhindered in all directions.

The strut is preferably connected by a hinge to an underside of the subpanel. This is a very simple connection of the strut to the subpanel. The strut is pivotally mounted in a recess in the fixed part of the telescoping column. This ensures a simple but robust connection of the strut to the telescoping column.

According to a further important feature of the table according to the invention, the fixed part of the telescoping column has a plurality of vertically offset recesses. This ensures that the strut can be fitted in a bore at a plurality of different levels so that the inclination angle of the subpanel and thus the angle of the head of a user relative to the monitor of an EDP system is also settable ergonomically optimally for users of different sizes.

The table according to the invention can have according to a preferred embodiment two struts which are pivotally mounted in respective bores in the fixed part of the telescoping column. In this manner the table according to the invention an be overall quite strong.

In order to provide more foot space, as a further feature the telescoping column is inclined at an angle of 10° to 20° from the vertical toward a user.

In order to be able to change the angle of the subpanel simply relative to the table top, the strut is formed of an upper partial strut element and a lower partial strut element that are connected together by a threaded sleeve.

Further adjustability for setting height is achieved when the fixed part of the telescoping column is provided with an outrigger to which the strut is connected. In the lowest position of the table top the strut extends nearly over the entire width of the table top but below it so that a longer strut is available for setting the height of the table top.

According to a further preferred embodiment the strut is braced with its free end on a bar extending at an angle to the vertical from the fixed part of the telescoping column so that the strut does not need to be fixedly connected to the telescoping column and the force can be conducted at a constant angle to the telescoping column.

To this end the strut is fixed on the subpanel so that the subpanel can be loaded and above all the subpanel is subject to less vibration which makes it harder to look at the monitor.

With respect to simplicity of construction it is preferably that the free end of the strut is formed as a slide surface. Alternatively a roller is provided on the free end of the strut.

In order to prevent the strut from lifting off the bar the free end of the strut engages in a lateral groove of the bar.

In order to be able to vary the angle of the subpanel the inclination of the bar is variable.

The stability of the table is increased when the bar is supported by its free end on the floor, thereby taking the function of a table leg and thus replacing the floor plate.

BRIEF DESCRIPTION OF THE DRAWING

The table according to the invention is described in the following with reference to a preferred embodiment which is shown in the drawing. Therein:

FIG. 1 is a side view of a preferred embodiment of the table according to the invention with a seated user;

FIG. 5A is a detail of another embodiment; and

SPECIFIC DESCRIPTION

Figure 2:
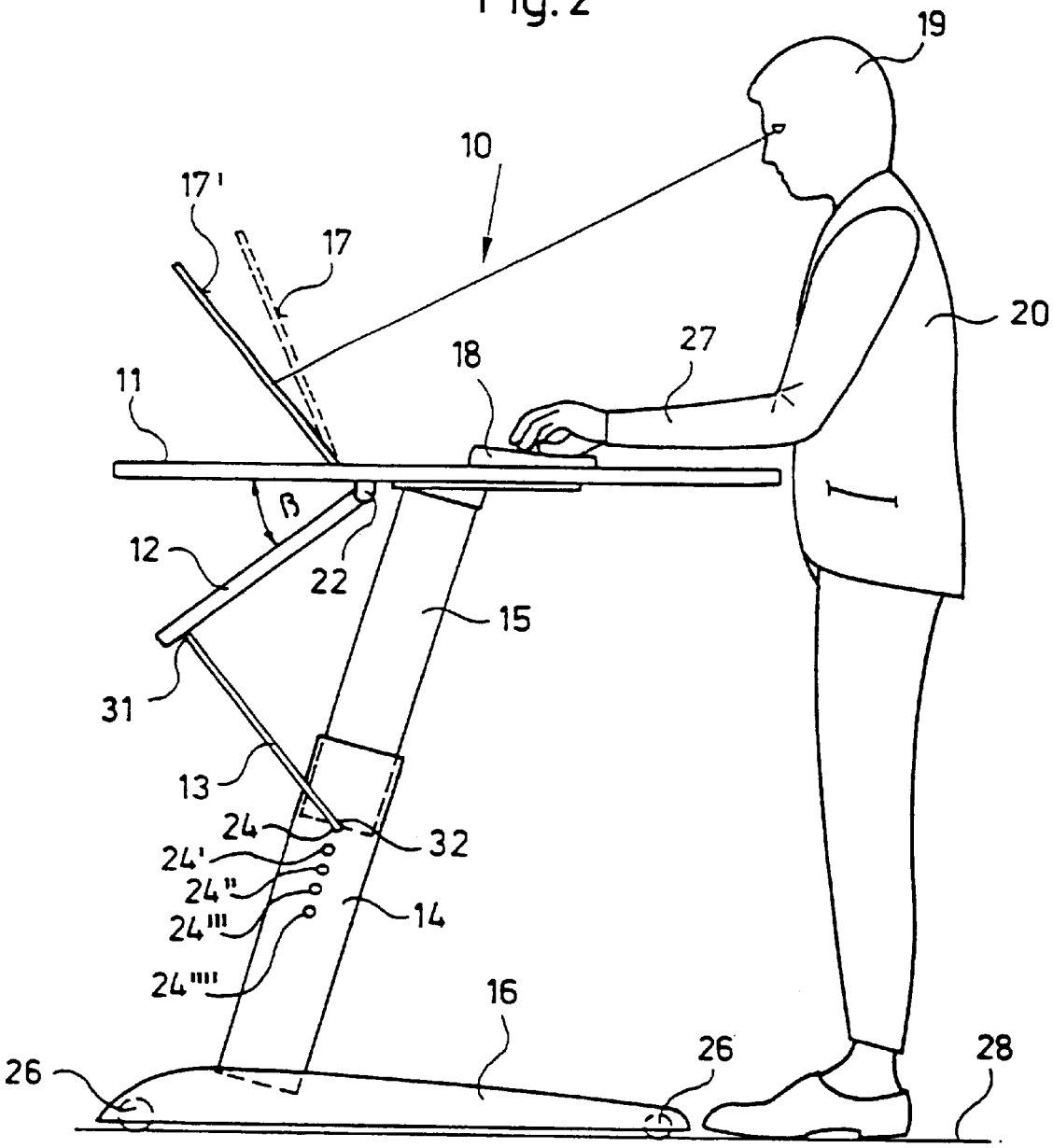
FIG. 2 is the table shown in FIG. 1 with a standing user.

In the table 10 shown in FIGS. 1 and 2 for an EDP system 17, 18 a table top 11 has a subpanel 12 that is pivotal about an axis 22 set 5 cm underneath an upper face of the table top 11 and that serves as support surface for a monitor with a screen 17. The subpanel 12 is connected via a strut 13 with a fixed part 14 of a telescoping column 14, 15 whose movable part is fixed to the underside of the table top 11 and carries the table top 11.

The strut 13 is connected by means of a hinge 31 to the subpanel, an end 32 of the strut 13 opposite the hinge 31 being fitted in a recess 24 in the fixed part 14 of the telescoping column 14, 15 and being pivotal in this recess 24. In order to change the inclination angle of the screen 17 of a monitor sitting on the subpanel 12 relative to a head 19 of a user 20 of the EDP system 17, 18 in dependence on the size of the person 20, further recesses 24', 24", 24'", and 24"" are provided in the fixed part 14 of the telescoping column 14, 15 for pivotally receiving the end 32 of the strut 13. The fixed part 14 of the telescoping column 14, 15 is fixed in a floor support or plate 16 provided with rollers 26.

The adjustable table 10 is shown in FIG. 1 in a position in which the keyboard 18 of the EDP system 17, 18 is being used by a seated person 20. The strut 13 of the subpanel 12 which is coupled to the monitor with the screen 17 is so mounted with its end 32 in the recess 24 in the fixed part 14 of the telescoping column 14, 15 that the angle of the head of the user 20 of the EDP system 17 ,18 relative to the screen 17 is such that the user assumes an ergonomically natural and comfortable body position while working with the EDP system 17, 18.

FIG. 2 shows the adjustable table 10 according to the invention in a position in which the user 20 is working while standing at the EDP system 17, 18. To this end the movable part 15 of the telescoping column 14, 15 is raised so far up from the fixed part 14 that the arm 27 of the user 20 is set generally parallel to the floor 28 and to the table top 11 when the keyboard of the EDP system 17, 18 is being used. As a result of the connection of the subpanel 12 on which the monitor with the screen 17 is mounted with the fixed part 14 of the telescoping column 14, 15 via the strut 13, in an extended position of the movable part relative to the telescoping column 14, 15 the subpanel assumes relative to the table top 11 a large angle $\beta$ instead of a small angle $\alpha$. In this manner the screen 17 changes its position relative to the table top 11 and assumes the changed positions shown at 17 in FIG. 2. In order to emphasize the change in position of the screen 17 FIG. 2 shows the original position from FIG. 1 in dashed lines next to the new position 17'.

Figure 3:
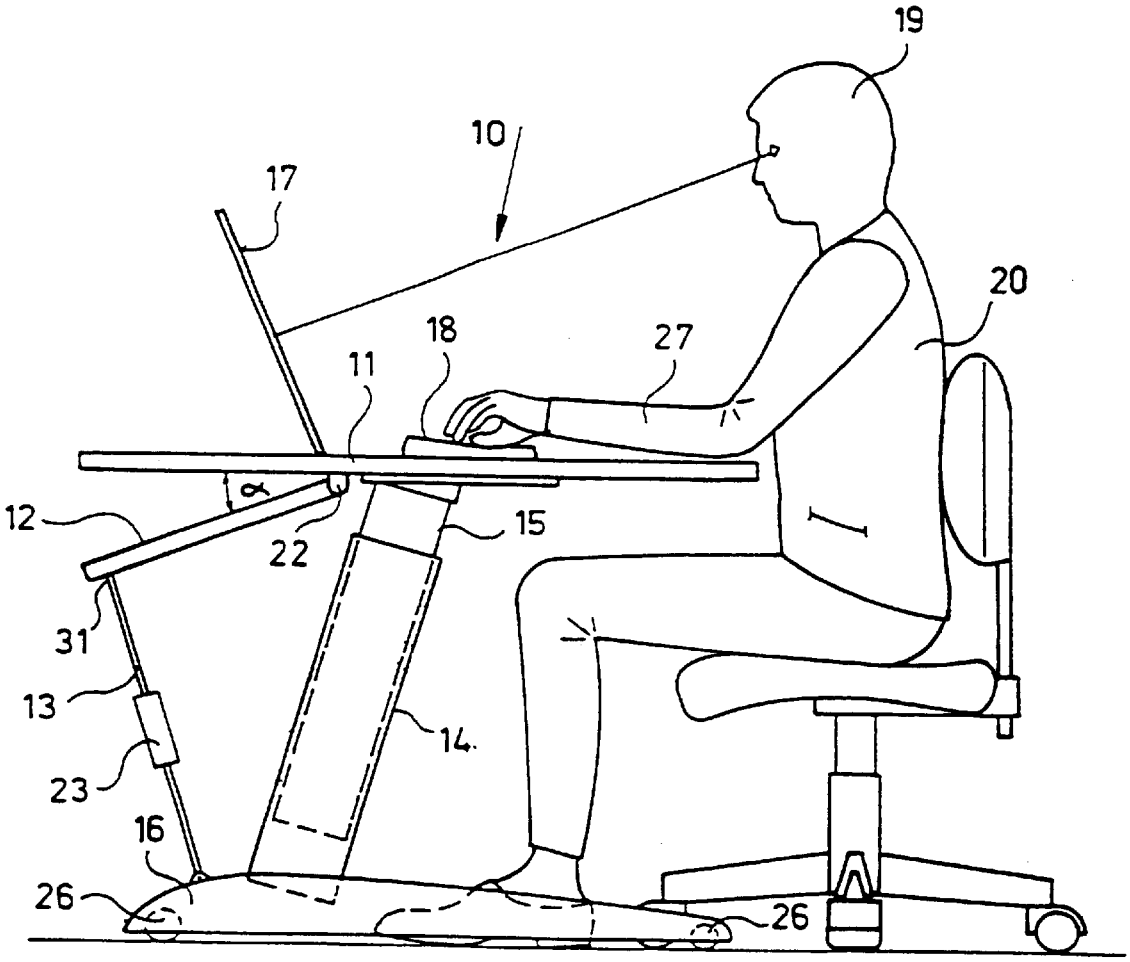
FIG. 3 is side view of an alternative embodiment of the table shown in FIG. 1.

The adjustable table 10' according to the invention shown in FIG. 3 is generally identical to the table 10 shown in FIG. 2. The table 10' is braced however by a strut 13' which sits on the floor plate 16. The strut 13' is made of two elements, and upper element and a lower element which are interconnected by a threaded sleeve 23. The threaded sleeve 23 has an internal screwthread that coacts with the externally threaded ends of the partial strut elements such that the strut 13 gets longer on rotation of the sleeve in one direction and gets shorter on rotation in the opposite direction so as to adjust the inclination angle of the subpanel 12.

Figure 4:
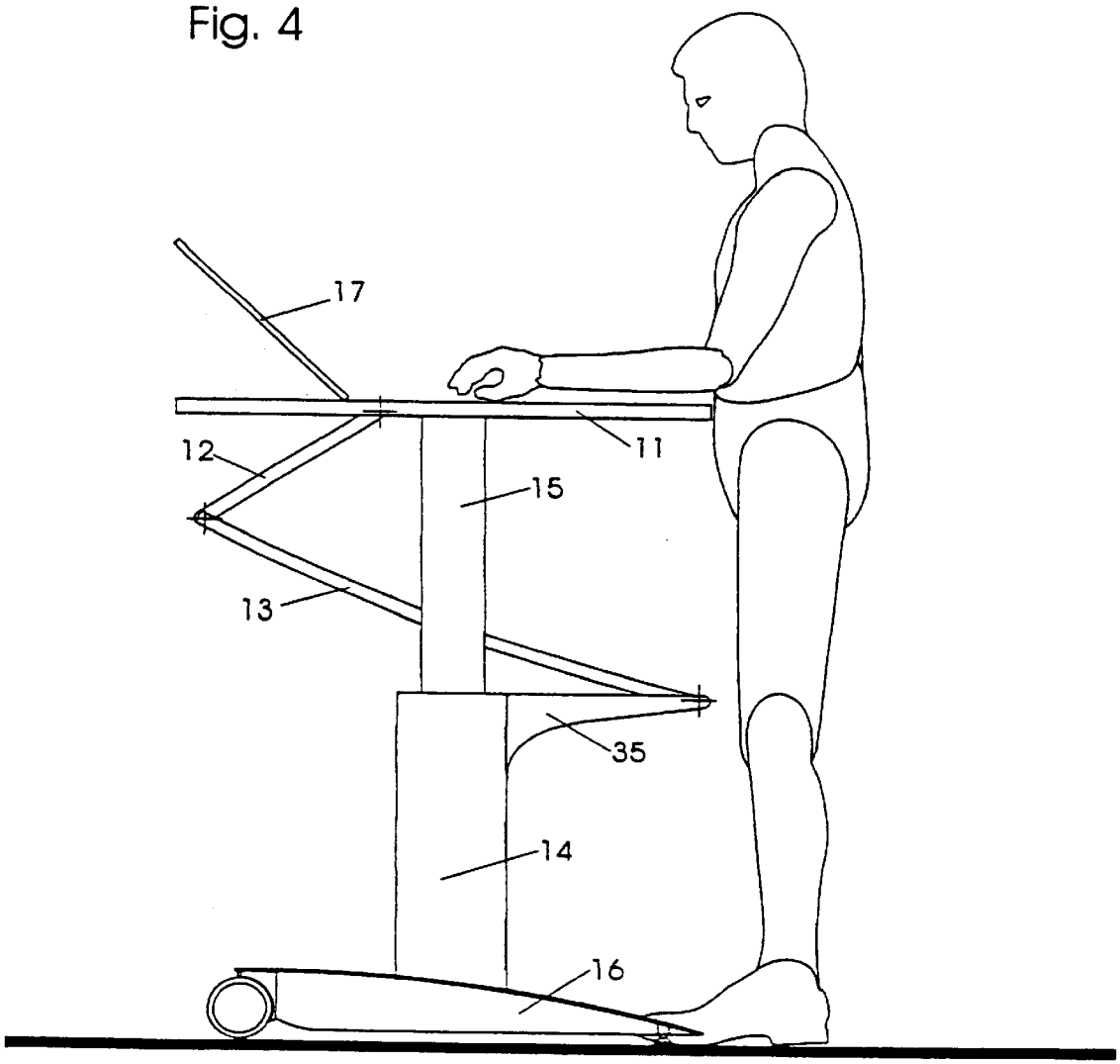
FIG. 4 is a table of the type shown in FIG. 2 with an outrigger on the fixed part of the telescoping column.

FIG. 4 shows an embodiment where an outrigger connected to the strut 13 is provided on the fixed part of the telescoping column.

Figure 5:
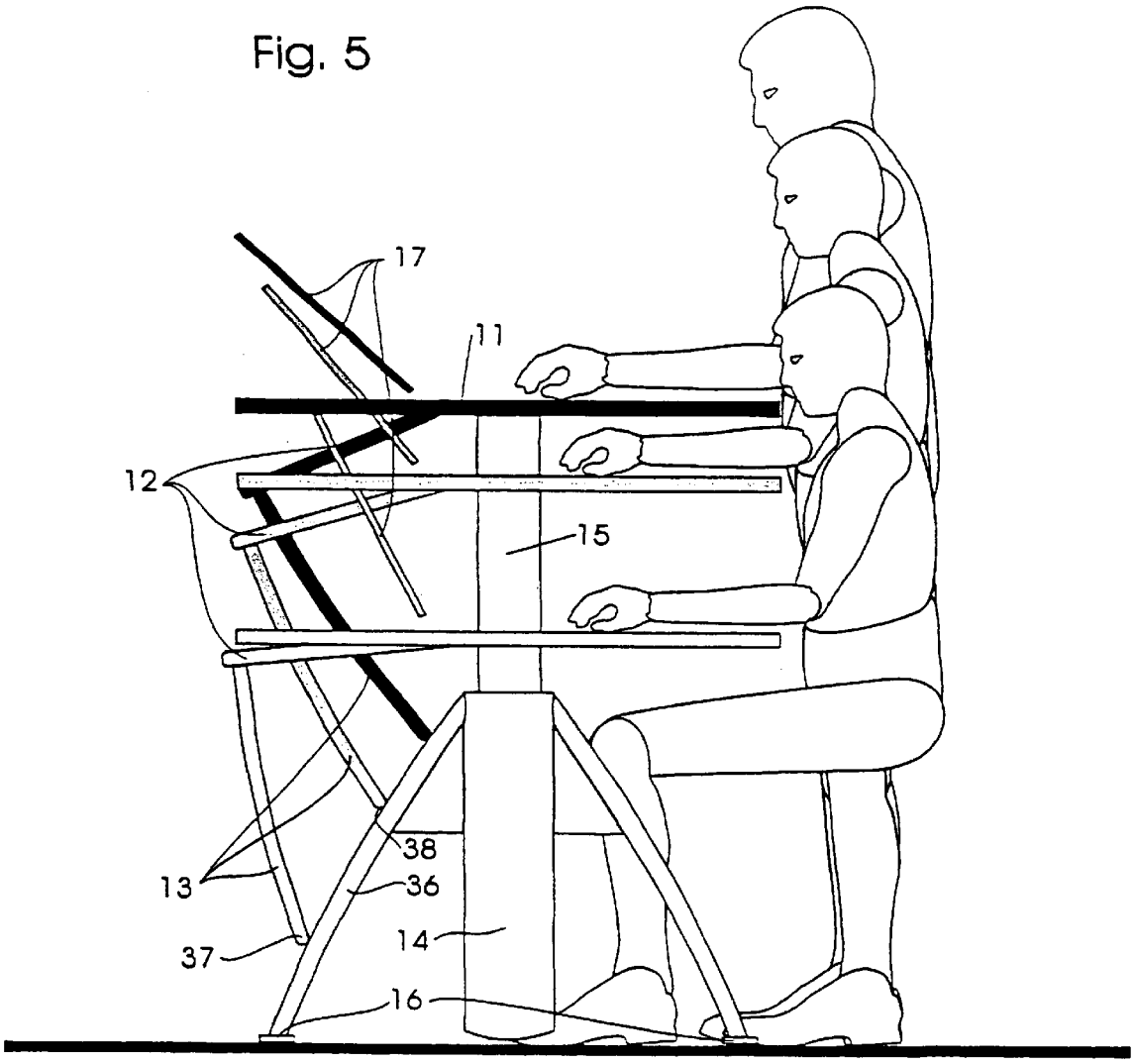
FIG. 5 is an overlain view of a table in three different height positions of the table top with a strut sliding on the fixed part of the telescoping column.
Figure 6:
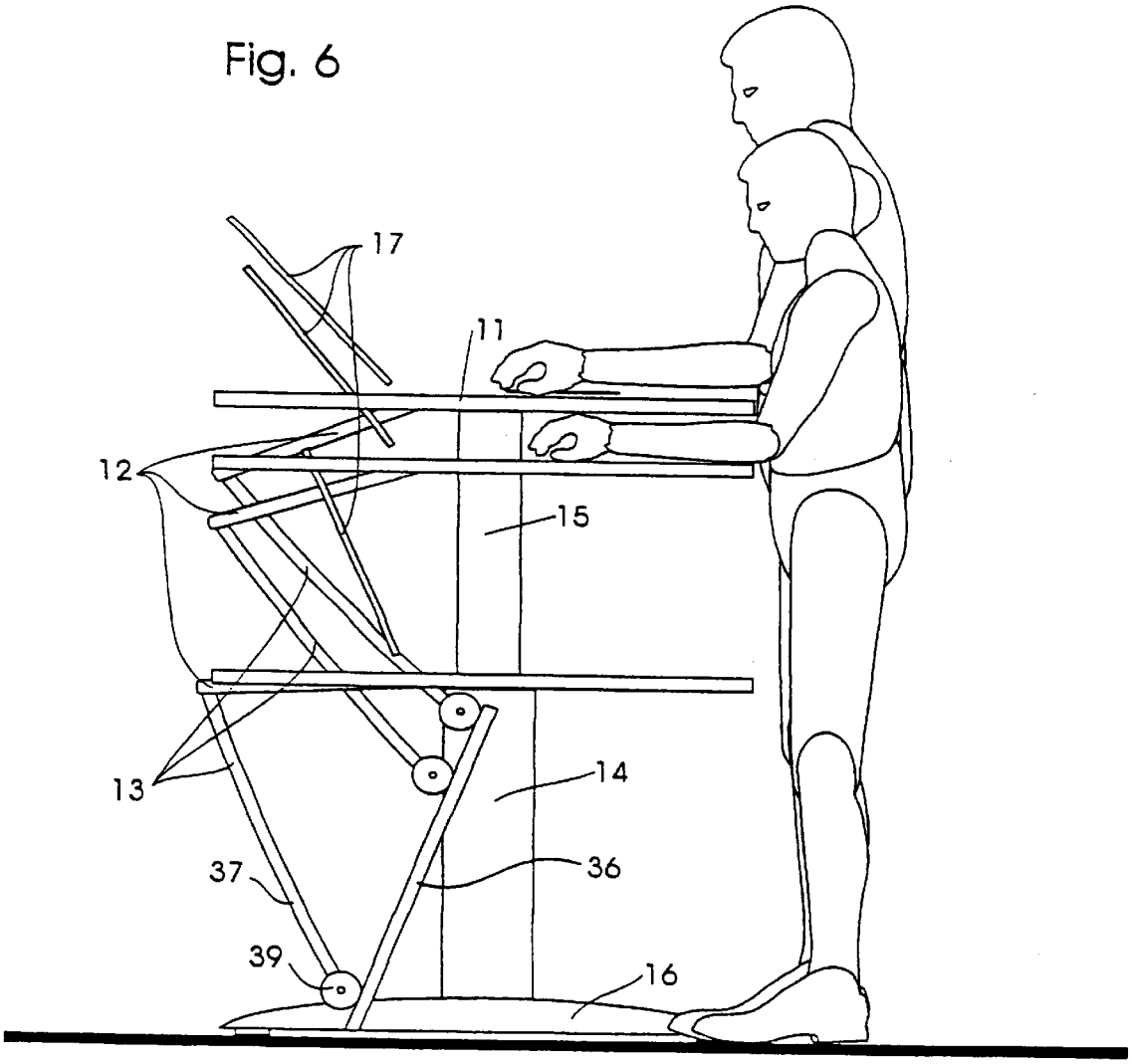
FIG. 6 is an embodiment with a roller on the free end of the strut.

FIGS. 5 and 6 show the strut 13 with its free end 37 bearing on a bar 36 inclined to the vertical and connected to the fixed part 14 of the telescoping column 14, 15 so as not to be fixed to the telescoping column 14, 15. Alternatively there is the possibility of forming the free end 37 as a slide surface or to provide a roller 39 on the free end 37 of the strut 13. In this case the strut 13 is fixed with respect to the subpanel 12.

According to an embodiment illustrated in FIG. 5A the free end 37 of the strut 13 engages in the bar 36 in lateral groove whose angle is variable in order to influence he angle of the subpanel 12.

FIGS. 5 and 6 show that the bar 36 has a lower end standing on the floor so that it serves as a table leg and thus increases the stability and the load-carrying capacity of the table.

What is claimed is:

1. An adjustable table for an EDP system having a monitor and a keyboard, said table comprising:

a base;

a telescoping column on said base and including a fixed part secured to said base and a movable part shiftable along said column upwardly and downwardly relative to said movable part;

a table top on said movable part having a front edge proximal to a user and a rear edge remote from said user;

a subpanel pivotally mounted on an underside of said table top between said front edge and said rear edge about a first pivot axis parallel to said front edge, said subpanel supporting a screen of said monitor at a variable angle relative to said table top; and a strut pivotally connected at one end to said subpanel at a second pivot axis and connected at another end to said fixed part.

2. The adjustable table defined in claim 1 wherein said base is a floor plate and said strut has said other end connected to said floor plate.

3. The adjustable table defined in claim 1 wherein said first pivot axis is located 2 cm to 5 cm below an upper surface of said table top.

4. The adjustable table defined in claim 1 wherein said other end of said strut is pivotally mounted in a recess in said fixed part of said column.

5. The adjustable table defined in claim 1 wherein said fixed part of said column has a plurality of vertically offset recesses and said other end of said strut is selectively received in said one of said recesses.

6. The adjustable table defined in claim 5 wherein two struts are provided between said fixed part and said subpanel, each of said struts being received in a respective bore of the fixed part of the telescoping column.

7. The adjustable table defined in claim 1 wherein said telescoping column is inclined on said base at an angle of 10° to 20° from the vertical toward said front edge.

8. The adjustable table defined in claim 1 wherein said strut is formed with an upper partial strut element and a lower partial strut element interconnected by a threaded sleeve.

9. The adjustable table defined in claim 1 wherein said fixed part of said column is formed with an outrigger to which said strut is connected.

10. The adjustable table defined in claim 1 wherein said other end of said strut is braced against a bar extending at an angle to the vertical from the fixed part of said column.

11. An adjustable table for an EDP system having a monitor and a keyboard, said table comprising:

a base;

a telescoping column on said base and including a fixed part secured to said base and a movable part shiftable along said column upwardly and downwardly relative to said movable part;

a table top on said movable part having a front edge proximal to a user and a rear edge remote from said user;

a subpanel pivotally mounted on an underside of said table top between said front edge and said rear edge about a first pivot axis parallel to said front edge, said subpanel supporting a screen of said monitor at a variable angle relative to said table top; and a strut fixedly connected at one end to said subpanel and bearing at another endon said fixed part.

12. The adjustable table defined in claim 1 wherein said other end is formed as a slide surface.

13. The adjustable table defined in claim 11, further comprising a roller on said other end of said strut.

14. The adjustable table defined in claim 11 wherein said other end of said strut slides in a lateral groove of a bar connected to said fixed part.

15. The adjustable table defined in claim 11 wherein said other end of said strut bears on said fixed part through a bar extending from said fixed part.

16. The adjustable table defined in claim 15 wherein said bar has a variable inclination angle.

17. The adjustable table defined in claim 15 wherein said bar is supported on the floor.

* * * * *